US006365336B1

(12) United States Patent
Maskasky et al.

(10) Patent No.: US 6,365,336 B1
(45) Date of Patent: Apr. 2, 2002

(54) AQUEOUS PHOTOTHERMOGRAPHIC IMAGING ELEMENTS COMPRISING AQUEOUS SILVER HALIDE EMULSIONS PRECIPITATED IN THE PRESENCE OF CATIONIC STARCH PEPTIZING AGENT

(75) Inventors: Joe E. Maskasky, Rochester; David A. Dickinson, Brockport; Mark Lelental, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/703,050

(22) Filed: Oct. 31, 2000

(51) Int. Cl.[7] ..... G03C 1/498
(52) U.S. Cl. ..... 430/619; 430/639; 430/641
(58) Field of Search ..... 430/619, 567, 430/639, 641, 569

(56) References Cited

U.S. PATENT DOCUMENTS

| | | | |
|---|---|---|---|
| 3,666,477 | A | 5/1972 | Goffe |
| 3,887,597 | A | 6/1975 | Ohkubo et al. |
| 5,604,085 | A | 2/1997 | Maskasky |
| 5,667,955 | A | 9/1997 | Maskasky |
| 5,691,131 | A | 11/1997 | Maskasky |
| 5,733,718 | A | 3/1998 | Maskasky |

FOREIGN PATENT DOCUMENTS

| | | | |
|---|---|---|---|
| EP | 0 848 286 | A1 | 6/1998 |

*Primary Examiner*—Thoral Chea
(74) *Attorney, Agent, or Firm*—J. Jeffrey Hawley

(57) ABSTRACT

There is disclosed an aqueous photothermographic composition comprising a) a photosensitive silver halide emulsion precipitated in a water dispersible cationic starch peptizing agent and b) an oxidation-reduction imaging forming composition comprising (I) a colloidal dispersion of silver compound particles and (ii) an organic reducing agent. The use of a starch peptizing agent reduces the fog in an element using the composition upon thermal processing.

17 Claims, No Drawings

AQUEOUS PHOTOTHERMOGRAPHIC IMAGING ELEMENTS COMPRISING AQUEOUS SILVER HALIDE EMULSIONS PRECIPITATED IN THE PRESENCE OF CATIONIC STARCH PEPTIZING AGENT

FIELD OF THE INVENTION

This invention relates to the use of aqueous silver halide emulsions precipitated in the presence of cationic starch peptizing agent to formulate imaging forming compositions that are useful in aqueous photothermographic imaging elements.

DESCRIPTION RELATIVE TO THE PRIOR ART

Photothermographic materials are well known in the photographic art. Photothermographic materials are also known as heat developable photographic materials. The photothermographic materials, after imagewise exposure, are heated to moderately elevated temperatures to produce a developed image in the absence of separate processing solutions or baths. The heat development can provide a developed silver image in the photothermographic material.

An example of a known photothermographic silver halide material comprises (a) a hydrophilic photosensitive silver halide emulsion containing a gelatino peptizer with (b) an organic solvent mixture, (c) a hydrophobic binder and (d) an oxidation-reduction image-forming composition. The oxidation-reduction imaging forming composition typically comprises (i) an organic silver compound that can be a silver salt of a long-chain fatty acid, such as silver behenate or silver stearate, in combination with (ii) an organic reducing agent, such as a phenolic reducing agent. It has been desirable to have hydrophilic photosensitive silver halide emulsion containing a gelatino peptizer in such a photothermographic material because of the higher photosensitivity of these silver halide emulsions and the ease of control in preparation of the emulsion based on conventional aqueous silver halide gelatino emulsion technology.

A problem that has been solved in the prior art relates to the preparation of these photothermographic silver halide materials. This problem involves the mixing of a hydrophilic photosensitive silver halide emulsion containing a gelatino peptizer with an oxidation-reduction imaging forming composition. The imaging forming composition contains hydrophobic components including a hydrophobic binder, such as poly(vinyl butyral), and a silver salt of a long-chain fatty acid, such as a silver salt of behenic acid. Typically, when the hydrophilic photosensitive silver halide emulsion is mixed with the hydrophobic imaging forming materials and then coated on a suitable support to produce a photothermographic element, the resulting element produces a less than desired degree of photosensitivity, contrast and maximum density upon exposure and heat processing. This problem has been encountered in photothermographic silver halide materials, as described in, for example, U.S. Pat. No. 3,666,477 of Goffe, issued May 30, 1972. Goffe proposed addition of alkylene oxide polymers and a mercaptotetrazole derivative to the photothermographic material to help provide increased photosensitivity. This problem has been substantially solved by formulating aqueous based photothermographic elements.

In addition, a variety of organic solvents have been proposed in order to help prepare a photothermographic silver halide composition containing the described image-forming components. The organic solvents that have been proposed include isopropanol, acetone, toluene, methanol, 2-methoxyethanol, chlorinated solvents, acetone-toluene mixtures and certain non-aqueous polar organic solvents. The described individual solvents, such as isopropanol, have not provided the desired improved properties. There has been a continuing need to reduce fog (Dmin) and to prevent fog growth on raw stock keeping.

The use of cationic starches as a peptizer for the precipitation of high bromide {111} tabular grain emulsions is taught by Maskasky U.S. Pat. No. 5,604,085, issued Feb. 18, 1997, U.S. Pat. No. 5,620,840, issued Apr. 15, 1997, U.S. Pat. No. 5,667,955, issued Sep. 16, 1997, U.S. Pat. No. 5,691,131, issued Nov. 25, 1997, and U.S. Pat. No. 5,733,718, issued Mar. 31, 1998. Oxidized cationic starches are advantageous in exhibiting lower levels of viscosity than gelatino-peptizers. This facilitates mixing. Under comparable levels of chemical sensitization higher photographic speeds can be realized using cationic starch peptizers. Alternatively, speeds equal to those obtained using gelatino-peptizers and lower Dmin densities can be achieved at lower precipitation and/or sensitization temperatures, thereby avoiding unwanted grain ripening. Furthermore, cationic starch peptized emulsions have been disclosed for use in gelatin based elements that are processed in aqueous processing solutions.

There is a continuing need for aqueous based photothermographic elements that exhibit good image discrimination while maintaining good keeping properties and low fog.

SUMMARY OF THE INVENTION

In one aspect of the invention, there is provided an aqueous photothermographic composition comprising a) a photosesitive silver halide emulsion containing a cationic starch peptizer and b) an oxidation-reduction imaging forming composition comprising (i) an aqueous dispersion of organic silver compound particles and (ii) an organic reducing agent. The described photothermographic composition can be coated on a support to provide a useful photothermographic element.

DETAILED DESCRIPTION OF THE INVENTION

The silver halide grains to be used in the invention may be prepared, similar to methods known in the art, such as those described in *Research Disclosure, item* 38957, *I. Emulsion Grains and Their Preparation*. These methods generally involve mixing a water soluble silver salt with a water soluble halide salt in the presence of a protective colloid (often refereed to as a peptizer, usually gelatin). The temperature, pAg, pH values, etc, are controlled at suitable values during formation of the silver halide grains by precipitation.

In the photothermographic elements and processes of the invention, it has been found that photosensitive silver halide grains made using water dispersible cationic starch solved the problems of higher than desired fog and less than optimum raw stock keeping.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch (which consists essentially of amylopectin) or high amylose corn starch.

The term "cationic" in referring to starch indicates that the starch molecule has a net positive charge at the pH of intended use.

The term "water dispersible" in referring to cationic starches indicates that, after boiling the cationic starch in water for 30 minutes, the water contains, dispersed to at least a colloidal level, at least 1.0 percent by weight of the total cationic starch.

Starches are generally comprised of two structurally distinctive polysaccharides, α-amylose and amylopectin. Both are comprised of α-D-gluco-pyranose units. In α-amylose the α-D-glucopyranose units form a 1,4-straight chain polymer. The repeating units take the following form:

(I)

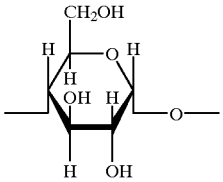

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time. High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings illustrate water dispersible cationic starches that are useful in the invention:

*Rutenberg et at U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et at U.S. Pat. No. 3,136,646;
*Barber et at U.S. Pat. No. 3,219,518;
*Mazzarella et at U.S. Pat. No. 3,320,080;
Black et at U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et at U.S. Pat. No. 3,467,647;
Brown et at U.S. Pat. No. 3,671,310;
Cescato U.S. Pat. No. 3,706,584;
Jarowenko et at U.S. Pat. No. 3,737,370;
*Jarowenko U.S. Pat. No. 3,770,472;
Moser et at U.S. Pat. No. 3,842,005;
Tessler U.S. Pat. No. 4,060,683;
Rankin et at U.S. Pat. No. 4,127,563;
Huchette et at U.S. Pat. No. 4,613,407;
Blixt et al U.S. Pat. No. 4,964,915;
*Tsai et at U.S. Pat. No. 5,227,481; and
*Tsai et at U.S. Pat. No. 5,349,089.

It is preferred to employ an oxidized cationic starch. The term "oxidized" in referring to starch indicates a starch in which, on average, at least one α-D-glucopyranose repeating unit per starch molecule has been ring opened by cleavage of the 2 to 3 ring position carbon-to-carbon bond. The starch can be oxidized before (* patents above) or following the addition of cationic substituents. This can be accomplished by treating the starch with a strong oxidizing agent. Both hypochlorite ($ClO^-$) or periodate ($IO_4^-$) have been extensively used and investigated in the preparation of commercial starch derivatives and preferred and are useful to produce the starch peptizers used in the present invention. While any convenient oxidizing agent counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are usually at the 2 and 3 position carbon atoms forming the α-D-glucopyranose ring. The 2 and 3 position

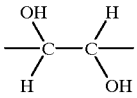

groups are commonly referred to as the glycol groups. The carbon-to-carbon bond between the glycol groups is replaced in the following manner:

(II)

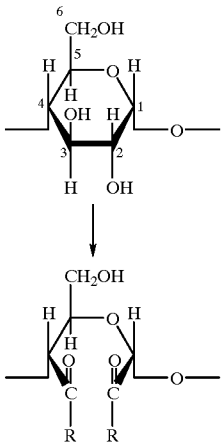

where R represents the atoms completing an aldehyde group or a carboxyl group.

The hypochlorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the α-D-glucopyranose repeating units themselves. Further oxidation, such as bromine oxidation during or following precipitation, produces the desired sensitometric effects in this invention (e.g. fog reduction). At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the high bromide {111} tabular grain emulsions e.g., up to a pBr of 3.0.

Cescato U.S. Pat. No. 3,706,584 discloses techniques for the hypochlorite oxidation of cationic starch. These techniques are useful to produce the starch peptizers used in the present invention. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physicochemical Properties of Wheat Starch with Alkaline Sodium Hypochlorite", *Journal of Polymer Science: Part A*, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, discloses the use of periodic acid to produce a starch dialdehyde that is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective of the oxidation is to reduce the viscosity of the cationic starch by oxidation to less than four times (400 percent of) the viscosity of water at the starch concentrations employed in silver halide precipitation.

Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

The water dispersible cationic starch is present during the precipitation (during nucleation and grain growth or during grain growth) of photosensitive silver halide grains. Preferably, precipitation is conducted by substituting the water dispersible cationic starch for all of the conventional gelatino-peptizers. In substituting the selected cationic starch peptizer for conventional gelatino-peptizers, the concentrations of the selected peptizer and the point or points of addition can correspond to those employed using gelatino-peptizers.

It is well known, as illustrated by Mignot U.S. Pat. No. 4,334,012, issued Jun. 8, 1982, that no peptizer is required to be present during grain nucleation. If desired, addition of the selected peptizer can be deferred until grain growth has progressed to the point that peptizer is actually required to avoid grain agglomeration.

The temperature of the reaction vessel within which the silver halide emulsion is prepared is typically maintained within a temperature range of about 20° C. to about 75° C. during the composition preparation. The temperature range and duration of the preparation can be altered to produce the desired emulsion grain size and desired composition properties. The silver halide emulsion can be prepared by means of emulsion preparation techniques and apparatus known in the photographic art.

It has been discovered that the minimum density can be reduced or eliminated by treating the emulsion with an oxidizing agent during or subsequent to grain precipitation. Preferred oxidizing agents are those that in a reduced form have little or no impact on the performance properties of the emulsions in which they are incorporated. Strong oxidizing agents noted above to be useful in oxidizing cationic starch, such as hypochlorite ($ClO^-$) or periodate ($IO_4^-$), are specifically contemplated. Specifically preferred oxidizing agents are halogen—e.g., bromine ($Br_2$) or iodine ($I_2$). When bromine or iodine is used as an oxidizing agent, the bromine or iodine is reduced to $Br^-$or $I^-$. These halide ions can remain with other excess halide ions in the dispersing medium of the emulsion or be incorporated within the grains without adversely influencing photographic performance. Any level of oxidizing agent can be utilized that is effective in reducing minimum density. Concentrations of oxidizing agent added to the emulsion as low as about $1\times10^{-6}$ mole per Ag mole are contemplated. Since very low levels of Ag° are responsible for increases in minimum density, no useful purpose is served by employing oxidizing agent concentrations of greater than 0.1 mole per Ag mole. A specifically preferred oxidizing agent range is from $1\times10^{-4}$ to $1\times10^{-2}$ mole per Ag mole. The silver basis is the total silver at the conclusion of precipitation of the silver halide emulsion, regardless of whether the oxidizing agent is added during or after precipitation.

High bromide {111} tabular grain emulsions (particularly when blended with other silver halide grains having different morphology) precipitated in the presence of a cationic starch are useful in the practice of the present invention and are disclosed in the following patents: Maskasky U.S. Pat. No. 5,604,085, issued Feb. 18, 1997, U.S. Pat. No. 5,620,840, issued Apr. 15, 1997, U.S. Pat. No. 5,667,955, issued Sep. 16, 1997, U.S. Pat. No. 5,691,131, Nov. 25, 1997, and U.S. Pat. No. 5,733,718, issued Mar. 31, 1998.

Conventional dopants can be incorporated into the grains during their precipitation, as illustrated by the patents cited above and *Research Disclosure*, Item 38957 Section I. Emulsion grains and their preparation, D. Grain modifying conditions and adjustments, paragraphs (3), (4) and (5). It is specifically contemplated to incorporate shallow electron trapping (SET) site providing dopants in the grains, further disclosed in *Research Disclosure*, Vol. 367, November 1994, Item 36736, and Olm et al U.S. Pat. No. 5,576,171, issued Nov. 19, 1996.

The emulsions useful in the invention would be expected to show sensitivity enhancements when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure*, Item 38957 Section IV. Chemical sensitizations. It is preferred to employ at least one of noble metal (typically gold) and middle chalcogen (typically sulfur) and, most preferably, a combination of both in preparing the emulsions used in the invention for photographic use. The use of a cationic starch peptizer allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

The silver halide emulsions used in the present invention are preferably free of soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al. U.S. Pat. No. 2,618,556, Yutzy et al. U.S. Pat. No. 2,614,928, Yackel U.S. Pat. No. 2,565,418, Hart et al. U.S. Pat. No. 3,241,969, Waller et al. U.S. Pat. No. 2,489,341, Klinger U.K. Pat. No. 1,305,409 and Dersch et al. U.K. Pat. No. 1,167,159; by centrifugation and decantation of a coagulated dispersion as illustrated by Murray U.S. Pat. No. 2,463,794, Ujihara et al. U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al. Soviet Chemical Industry, Vol. 6, No. 3, 1974, pp. 181–185; by diafiltration with a semipermeable membrane, as illustrated by Research Disclosure, Vol. 102, October 1972, Item 10208, Hagemaier et al. Research Disclosure, Vol. 131, March 1975, Item 13122, Bonnet Research Disclosure, Vol. 135, July 1975, Item 13577, Berg et al. German OLS No. 2,436,461, Bolton U.S. Pat. No. 2,495,918, and Mignot U.S. Pat. No. 4,334,012 or by employing an ion exchange resin, as illustrated by Maley U.S. Pat. No. 3,782,953 and Noble U.S. Pat. No. 2,827,428.

In one aspect of the invention, the described starch peptized emulsions are used in photothermographic elements. Exposure of the silver halide produces a latent image that is then developed by an oxidation-reduction composition including organic silver compound particles. An aqueous photothermographic composition according to the invention can be prepared by very thoroughly mixing (I) a hydrophilic photosensitive silver halide emulsion with (II) (a) a hydrophilic binder and (b) an oxidation-reduction image-forming composition comprising (i) an aqueous dispersion of a silver organic compound such as silver carboxylate with (ii) an organic reducing agent in water. A photothermographic element according to the invention can be prepared by coating the resulting photothermographic composition on a suitable support.

The aqueous photothermographic materials comprise a photosensitive silver halide. The photosensitive silver halide is in the form of a hydrophilic photosensitive silver halide emulsion containing a cationic starch peptizer. A typical concentration of hydrophilic photosensitive silver halide emulsion containing a cationic starch peptizer and the imaging forming composition is within the range of about 0.02 to about 1.0 mole of photosensitive silver halide per mole of the described silver compound in the photothermographic material. Other photosensitive materials can be useful in combination with the described photosensitive silver halide if desired. Preferred photosensitive silver halides are silver chloride, silver iodobromide, silver bromide, silver iodobromochloride, silver chlorobromide or mixtures thereof. For purposes of the invention, silver iodide is also considered to be a photosensitive silver halide.

A range of grain size and grain morphology of photosensitive silver halide from very coarse grain to very fine grain and from 3D to tabular silver halide is useful. Tabular grain photosensitive silver halide is useful, as described in, for example, U.S. Pat. No. 4,435,499, of Reeves; issued Mar. 6, 1984. Particularly useful are ultra-thin tabular silver halide grains made using as peptizer a water dispersible cationic starch as described in U.S. Pat. No. 5,667,955, of Maskasky, issued Sep. 16, 1997 and U.S. Pat. No. 5,604,085, of Maskasky, issued Feb. 18, 1997. Very fine grain silver halide is preferred. Blends of fine grain silver halide with coarser silver halide grains are also useful.

The hydrophilic photosensitive silver halide emulsion containing a cationic starch peptizer can be prepared by any of the procedures known in the photographic art which involve the preparation of photographic silver halide emulsion. Useful procedures and forms of photosensitive silver halide emulsions for purposes of the invention are described in, for example, the Product Licensing Index, Volume 92, December 1971, Publication 9232 on page 107, published by Industrial Opportunities Limited, Homewell, Havant Hampshire, P09 IEF, UK. The photographic silver halide, as described, can be washed or unwashed, can be chemically sensitized using chemical sensitization procedures. Materials known in the photographic art can be protected against the production of fog and stabilized against loss of sensitivity during keeping as described in the mentioned Product Licensing Index publication.

The photosensitive silver halide emulsion can contain a range of concentration of the cationic starch peptizer. Typically, the concentration of the starch peptizer is within the range of about 1 gram to about 500 grams of cationic starch peptizer, per mole of silver in the silver halide emulsion. This is described herein as a low-peptizer silver halide emulsion. A preferably useful concentration of cationic starch peptizer is within the range of about 5 to about 100 grams of a cationic starch peptizer per mole of silver in the silver halide emulsion. A most preferably useful concentration of cationic starch peptizer is within the range of about 10 to about 50 grams of cationic starch peptizer per mole of silver in the silver halide emulsion. The optimum concentration of the cationic starch peptizer will depend upon such factors as the particular photosensitive silver halide, the desired image, the particular components of the photothermographic composition, coating conditions and the like. All of the selected peptizer required for the preparation of an emulsion through the optional step of chemical sensitization can be present in the reaction vessel prior to grain nucleation.

Emulsions precipitated in the presence of cationic starch peptizing agent have been successfully incorporated with the other necessary ingredients into an aqueous photothermographic imaging element and successfully exposed and thermally processed using a laser printer and thermal processor.

The materials of this invention offer several advantages over the materials using gelatino-peptizing agents. Many of the commonly used gelatino peptizing agents often cause adverse photographic effects, in particular fog, loss of contrast, loss of maximum density, and poor keeping. The silver halide emulsions, precipitated in the presence of cationic starch peptizing agent, used according to this invention offer the advantage that they do not show these adverse photographic effects.

The present invention provides a photothermographic imaging element comprising a support having thereon an aqueous photothermographic composition comprising a) a photosensitive silver halide emulsion precipitated in the presence of a cationic starch peptizer and b) an oxidation-reduction imaging forming composition comprising (i) an aqueous dispersion of organic silver compound particles, and (ii) an organic reducing agent.

The organic silver compound for the oxidation-reduction imaging forming composition can be a silver carboxylate such as the silver salt of a long-chain fatty acid.

Other silver salts or complexes have been proposed for heat developable photographic materials. These include, for example, silver salts of benzotriazole, silver salts of saccharin and related silver salts or complexes. These are described, for example, in heat developable photographic materials in U.S. Pat. No. 3,617,289 of Ohkubo et al, issued Oct. 2, 1971; U.S. Pat. No. 3,666,477 of Goffe, issued May 30, 1972; U.S. Pat. No. 3,672,904 of deMauriac, issued Jun. 27, 1972; U.S. Pat. No. 3,832,186 of Masuda et al, issued Aug. 27, 1974; British specification No. 1,205,500 published Sep. 16, 1970; U.S. Pat. No. 3,689,270 of Anderson et al, issued Sep. 5, 1972; and German Offenlegungsschrift No. 2,326,865 published Dec. 6, 1973. Other silver complexes or salts in heat developable materials, which include silver salts of nitrogen acids, are described in Research Disclosure, October 1976, Item 15026, pages 18–21, of R. A. deMauriac.

Nanoparticulate silver carboxylate dispersions can be prepared by a precipitation process commonly used for the precipitation of photographic silver halide emulsions. Into a vigorously stirred reaction is introduced a surface modifier. Frequently, the surface modifier initially introduced into the reaction vessel is at least about 10 percent, preferably 20 to 100 percent, by weight based on total weight of the surface modifier present in the nanoparticulate silver carboxylate at the conclusion of grain precipitation. Since surface modifier can be removed from the reaction vessel by ultrafiltration during silver carboxylate grain precipitation, as taught by Mignot U.S. Pat. No. 4,334,012, issued Jun. 8, 1982, it is appreciated that the weight of surface modifier initially present in the reaction vessel can equal or even exceed the dry weight of the silver carboxylate present in the reaction vessel at the conclusion of the precipitation. The surface modifier initially introduced into the reaction vessel is preferably aqueous solution or an aqueous dispersion of surface modifier, optionally containing other ingredients, such as one or more antifoggant and/or various dopants, more specifically described below. Where a surface modifier is initially present, it is preferably employed in a concentration of at least 10 percent, most preferably at least 20 percent, of the total surface modifier present at the completion of nanoparticulate silver carboxylate precipitation. Additional surface modifier is added to the reaction vessel with the water soluble silver salts and can also be introduced through a separate jet.

During precipitation silver and carboxylate salts are added to the reaction vessel by techniques well known in the precipitation of photographic silver halide grains. The carboxylate salts are typically introduced as aqueous salt solutions, such as aqueous solutions of one or more soluble ammonium, alkali metal (e.g., sodium or potassium), or alkaline earth metal (e.g., magnesium or calcium) carboxylate salts. The silver salt is at least initially introduced into the reaction vessel separately from the carboxylate salt.

With the introduction of silver salt into the reaction vessel the nucleation stage of silver carboxylate grain formation is initiated. A population of grain nuclei is formed which is capable of serving as precipitation sites for silver carboxylate as the introduction of silver and (or) carboxylic acid salts continues. The precipitation of silver carboxylate onto existing grain nuclei constitutes the growth stage of nanoparticulate grain formation.

As an alternative to the introduction of silver and (or) carboxylic acid salts as aqueous solutions, it is specifically contemplated to introduce the silver salt and carboxylic acid, initially or in the growth stage, in the form of ultrafine grains suspended in dispersing medium. The grain size is such that they readily react to form a nanoparticulate silver carboxylate grains. The maximum useful grain sizes will depend on the specific conditions within the reaction vessel, such as temperature and the presence of solubilizing agents.

The organic silver compound, e.g. silver and carboxylic salt or carboxylic acid grains, are preferably very fine e.g., less than 1.0 micron in mean diameter and more preferrably less than 0.2 micron.

Where the organic silver compound is a silver carboxylate, the concentrations and rates of silver, carboxylic acid salt introductions can take any convenient conventional form. The silver and carboxylic acid salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and carboxylic acid salt introduction during the run. The rate of silver and or carboxylic acid salt introduction can be increased either by increasing the rate at which the silver and or carboxylic acid salts are introduced or by increasing the concentrations of the silver and carboxylic acid salts within the solution.

The individual silver and (or) carboxylic acid salts can be added to the reaction vessel through surface or subsurface delivery tubes by gravity feed or by delivery apparatus for maintaining control of the rate of delivery and the pH, and/or pAg of the reaction vessel contents, as illustrated by Culhane et al. U.S. Pat. No. 3,821,002, Oliver U.S. Pat. No. 3,031,304 and Claes et al., Photographische Korrespondenz, Band 102, Nov. 10, 1967, p. 162. In order to obtain rapid distribution of the reactants within the reaction vessel, specially constructed mixing devices can be employed, as illustrated by Audran U.S. Pat. No. 2,996,287, McCrossen et al. U.S. Pat. No. 3,342,605, Frame et al. U.S. Pat. No. 3,415,650, Porter et al. U.S. Pat. No. 3,785,777, issued Jan. 15, 1974, Finnicum et al. U.S. Pat. No. 4,147,551, issued Apr. 3, 1979, Verhille et al. U.S. Pat. No. 4,171,224, issued Oct. 16, 1979, Calamur U.K. Patent Application No. 2,022,431A, Saito et al. German OLS Nos. 2,555,364 and 2,556,885, and Research Disclosure, Volume 166, February 1978, Item 16662.

In forming silver carboxylate dispersions in the presence of a surface modifier, a surface modifier is initially contained in the reaction vessel. In a preferred form the surface modifier is comprised of an aqueous solution. Surface modifier concentrations of from 0.1 to about 30 percent by weight, based on the total weight of dispersion components in the reaction vessel, can be employed. It is desirable to maintain the concentration of the surface modifier in the reaction vessel in the range of below about 25 percent, based on the total weight, prior to and during silver carboxylate formation. It is contemplated that the silver carboxylate dispersion as initially formed will contain from about 1 to 200 grams of surface modifier per mole of silver carboxylate preferably about 10 to 100 grams of surface modifier per mole of silver carboxylate. Additional surface modifier can be added later to bring the concentration up to as high as 200 grams per mole of silver carboxylate.

Vehicles (which include both binders and peptizers) can be employed. Preferred peptizers are hydrophilic colloids, which can be employed alone or in combination with hydrophobic materials. Suitable hydrophilic materials include substances such as proteins, protein derivatives, cellulose derivatives e.g., cellulose esters, gelatin e.g., alkali-treated gelatin (cattle bone or hide gelatin) or acid-treated gelatin (pigskin gelatin), gelatin derivatives e.g., acetylated gelatin, phthalated gelatin and the like, polysaccharides such as dextran, gum arabic, zein, casein, pectin, collagen derivatives, agaragar, arrowroot, albumin and the like as described in Yutzy et al. U.S. Pat. Nos. 2,614,928 and '929, Lowe et al., U.S. Pat. Nos. 2,691,582, 2,614,930, '931, 2,327,808 and 2,448,534, Gates et al. U.S. Pat. Nos. 2,787,545 and 2,956,880, Himmelmann et al. U.S. Pat. No. 3,061,436, Farrell et al. U.S. Pat. No. 2,816,027, Ryan U.S. Pat. Nos. 3,132,945, 3,138,461 and 3,186,846, Dersch et al. U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al. U.S. Pat. Nos. 2,992,213, 3,157,506, 3,184,312 and 3,539,353, Miller et al. U.S. Pat. No. 3,227,571, Boyer et al. U.S. Pat. No. 3,532,502, Malan U.S. Pat. No. 3,551,151, Lohmer et al. U.S. Pat. No. 4,018,609, issued Apr. 19, 1977, Luciani et al. U.K. Pat. No. 1,186,790, Hori et al. U.K. Pat. No. 1,489,080 and Belgian Pat. No. 856,631, U.K. Pat. No. 1,490,644, U.K. Pat. No. 1,483,551, Arase et al. U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al. U.S. Pat. No. 2,725,293, Hilborn U.S. Pat. No. 2,748,022, DePauw et al. U.S. Pat. No. 2,956,883, Ritchie U.K. Pat. No. 2,095, DeStubner U.S. Pat. No. 1,752,069, Sheppard et al. U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al. U.S. Pat. No. 3,923,517.

Other materials commonly employed in combination with hydrophilic colloid peptizers as vehicles (including vehicle extenders—e.g., materials in the form of lattices) include starches and synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al. U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al. U.S. Pat. Nos. 2,484,456, 2,541,474 and 2,632,704, Perry et al. U.S. Pat. No. 3,425,836, Smith et al. U.S. Pat. Nos. 3,415,653 and 3,615,624, Smith U.S. Pat. No. 3,488,708, Whiteley et al. U.S. Pat. Nos. 3,392,025 and 3,511,818, Fitzgerald U.S. Pat. Nos. 3,681,079, 3,721,565, issued Mar. 20, 1973, U.S. Pat. No. 3,852,073, issued Dec. 3, 1974, U.S. Pat. No. 3,861,918, issued Jan. 21, 1975, and U.S. Pat. No. 3,925,083, issued Dec. 9, 1975, Fitzgerald et al. U.S. Pat. No. 3,879,205, issued Apr. 22, 1975, Nottorf U.S. Pat. No. 3,142,568, Houck et al. U.S. Pat. Nos. 3,062,674 and 3,220,844, Dann et al. U.S. Pat. No. 2,882,161, Schupp U.S. Pat. No. 2,579,016, Weaver U.S. Pat. No. 2,829,053, Alles et al. U.S. Pat. No. 2,698,240, Priest et al. U.S. Pat. No. 3,003,879, Merrill et al. U.S. Pat. No. 3,419,397, Stonham U.S. Pat. No. 3,284,207, Lohmer et al. U.S. Pat. No. 3,167,430, Williams U.S. Pat. No. 2,957,767, Dawson et al. U.S. Pat. No. 2,893,867, Smith et al. U.S. Pat. Nos. 2,860,986 and 2,904,539, Ponticello et al. U.S. Pat. No. 3,929,482, issued Dec. 30, 1975 and U.S. Pat. No. 3,860,428, issued Jan. 14, 1975, Ponticello U.S. Pat. No. 3,939,130, issued Feb. 17, 1976, Dykstra U.S. Pat. No. 3,411,911 and Dykstra et al. Canadian Pat. No. 774,054, Ream et al. U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al. U.S. Pat. Nos. 2,865,893 and 2,875,059, Rees et al. U.S. Pat. No. 3,536,491, Broadhead et al. U.K. Pat. No. 1,348,815, Taylor et al. U.S. Pat. No. 3,479,186, Merrill et al. U.S. Pat. No. 3,520,857, Bacon et al. U.S. Pat. No. 3,690,888, Bowman U.S. Pat. No. 3,748,143, Dickinson et al. U.K. Pat. Nos. 808,227 and '228, Wood U.K. Pat. No. 822,192 and Iguchi et al. U.K. Pat. No. 1,398,055. These additional materials need not be present in the reaction vessel during silver carboxylate precipitation, but rather are conventionally added to the dispersion prior to coating. The vehicle materials, including particularly the hydrophilic colloids, as well as the hydrophobic materials useful in combination therewith can be employed not only in the emulsion layers of the photothermographic elements of this invention, but also in other layers, such as overcoat layers, interlayers and layers positioned beneath the emulsion layers.

A variety of hydrophilic binders are useful in the described photothermographic materials. The binders that are useful include various colloids alone or in combination as vehicles and/or binding agents. The hydrophilic binders which are suitable include transparent or translucent materials and include both naturally occurring substances, such as proteins, gelatin, gelatin derivatives, cellulose derivatives, polysaccharides, such as dextrin, gum arabic and the like: and synthetic polymeric substances such as water-soluble polyvinyl compounds like polyvinyl alcohol, poly(vinyl pyrrolidone), acrylamide polymers and the like. Other synthetic polymeric compounds, which can be employed include dispersed vinyl compounds such as latex form and particularly those that increase dimensional stability of photographic materials. A range of concentration of hydrophilic binder can be useful in the photothermographic silver halide materials according to the invention. Typically, the concentration of hydrophilic binder in a photothermographic silver halide composition according to the invention is within the range of about 50 to about 1000 mg/dm$^2$. An optimum concentration of the described binder can vary depending upon such factors as the particular binder, other components of the photothermographic material, coating conditions, desired image, processing temperature and conditions and the like.

If desired, a portion of the photographic silver halide in the photothermographic composition according to the invention can be prepared in situ in the photothermographic material. The photothermographic composition, for example, can contain a portion of the photographic silver halide that is prepared in or on one or more of the other components of the described photothermographic material rather than prepared separate from the described components and then admixed with them. Such a method of preparing silver halide in situ is described in, for example, U.S. Pat. No. 3,457,075 of Morgan et al., issued Jul. 22, 1969.

The described photothermographic composition comprises an oxidation-reduction image-forming combination can contain a silver carboxylate, which can be a long-chain fatty acid silver salt, with a suitable reducing agent. The oxidation-reduction reaction resulting from this combination upon heating is believed to be catalyzed by the latent image silver from the photosensitive silver halide produced upon imagewise exposure of the photothermographic material followed by overall heating of the photothermographic material. The exact mechanism of image formation is not fully understood.

A variety of silver salts of long-chain fatty acids are useful in the photothermographic materials according to the invention. The term "long-chain" as used herein is intended to refer to a fatty acid containing 8 to 30 carbon atoms and which is typically resistant to darkening upon exposure to light. Useful long-chain fatty acid silver salts include, for example, silver stearate, silver behenate, silver caprate, silver hydroxystearate, silver myristate and silver palmitate. A minor proportion of another silver salt oxidizing agent which is not a long-chain fatty acid silver salt can be useful in combination with the silver salt of the long-chain fatty acid if desired. Such silver salts which can be useful in combination with the described silver salts of a long-chain fatty acid include, for example, silver benzotriazole, silver imidazole, silver benzoate and the like. Combinations of silver salts of long-chain fatty acids can be useful in the described photothermographic materials if desired.

A variety of organic reducing agents are useful in the described photothermographicoxidation-reduction composition. These are typically silver halide developing agents that produce the desired oxidation-reduction image-forming reaction upon exposure and heating of the described photothermographic silver halide material. Examples of useful reducing agents include: polyhydroxybenzenes, such as hydroquinone and alkyl substituted hydroquinones; catechols and pyrogallol; phenylenediamine developing agents; aminophenol developing agents; ascorbic acid developing agents, such as ascorbic acid and ascorbic acid ketals and other ascorbic acid derivatives; hydroxylamine developing agents; 3-pyrazolidone developing agents such as 1-phenyl-3-pyrazolidone and 4-methyl-4-hydroxymethyl-1-phenyl-3-pyrazolidone; hydroxytetronic acid and hydroxytetronamide developing agents; reductone developing agents; bis-naphthol reducing agents; sulfonamidophenol reducing agents and the like. Combinations of organic reducing agents can be useful in the described photothermographic silver halide materials. Sulfonamidophenol developing agents, such as described in Belgian Pat. No. 802,519 issued Jan. 18, 1974 can be especially useful in the photothermographic silver halide composition.

A range of concentration of the organic reducing agent can be useful in the described photothermographic silver halide materials. The concentration of organic reducing agent is typically within the range of about 5 mg/dm$^2$ to about 20 mg/dm$^2$, such as within the range of about 10 to about 17 mg/dm$^2$. The optimum concentration of organic reducing agent will depend upon such factors as the particular carboxylate, e.g. long-chain fatty acid, the desired image, processing conditions, the particular solvent mixture, coating conditions and the like.

The order of addition of the described components for preparing the photothermographic composition before coating the composition onto a suitable support is important to obtain optimum photographic speed, contrast and maximum density.

A variety of mixing devices is useful for preparing the described compositions. However, the mixing device should be one that provides very thorough mixing. Mixing devices that are useful are commercially available colloid mill mixers and dispersator mixers known in the photographic art.

It is desirable, in some cases, to have what is described as a toning agent, also known as an activator-toning agent, in the photothermographic material according to the invention. Combinations of toning agents can often be useful. Typical toning agents include, for example, phthalimide, succinimide, N-hydroxyphthalimide, N-hydroxy-1,8-naphthalimide, N-hydroxysuccinimide, 1-(2H) phthalazinone and phthalazinone derivatives.

Photothermographic materials can contain other addenda that are useful in imaging. Suitable addenda in the described photothermographic materials include development modifiers that function as speed-increasing compounds, hardeners, antistatic layers, plasticizers and lubricants, coating aids, brighteners, spectral sensitizing dyes, antifoggants, charge control agents, absorbing and filter dyes, matting agents and the like.

The specific addenda depend on the exact nature of the imaging element. Photothermographic materials are useful for forming laser output media useful for reproducing x-ray images; it is useful for forming microfilm elements and it is useful to form graphic arts elements. Each of these applications has well known features requiring specialized addenda known in the respective arts for these elements.

As noted, the present invention uses a silver halide emulsion precipitated in the presence of a cationic starch peptizer. These emulsions are incorporated into an aqueous photothermographic imaging element. An important advantage of these compositions is that they can be coated from an aqueous environment. Several current commercial elements (not using a starch peptizer) of this type are currently coated from organic solvents. The present invention can be used to convert these products into aqueous coated products. In this process, some of the components typically found in these elements might not be as soluble in water as desired. These components also can be made into nanoparticulate dispersions. [Needs to be placed into context.] It is useful in certain cases to include a stabilizer in the described photothermographic material. This can help in stabilization of a developed image. Combinations of stabilizers can be useful if desired. Typical stabilizers or stabilizer precursors include certain halogen compounds, such as tetrabromobutane and 2-(tribromomethylsulfonyl, benzothiazole, which provide improved postprocessing stability and azothioethers and blocked azoline thione stabilizer precursors.

A photothermographic element according to the invention can have a transparent protective layer. This protective layer can comprise a film forming binder, preferable a hydrophilic film forming binder. Such binders include, for example, crosslinked polyvinyl alcohol, gelatin, poly(silicic acid), and the like. Particularly preferred are binders comprising poly (silicic acid) alone or in combination with a water-soluble hydroxyl-containing monomer or polymer as described in the U.S. Pat. No. No. 4,828,971 of Przezkziecki, issued May 9, 1989.

The term "protective layer" is used to mean a transparent, image insensitive layer that can be an overcoat layer, that is a layer that overlies the image sensitive layer(s). The protective layer can also be a backing layer, that is, a layer that is on the opposite side of the support from the image sensitive layer(s). The imaging element can contain an adhesive interlayer or adhesion promoting interlayer between the protective layer and the underlying layer(s). The protective layer is not necessarily the outermost layer of the imaging element.

The protective layer can contain an electrically conductive layer having a surface resistivity of less than $5\times10^{11}$ ohms/square. Such electrically conductive overcoat layers are described, for example, in U.S. Pat. No. 5,547,821 of Melpolder et al, issued Aug. 20, 1996.

A photothermographic imaging element can include at least one transparent protective layer containing matte particles. Either organic or inorganic matte particles can be used. Examples of organic matte particles are beads of polymers such as polymeric esters of acrylic and methacrylic acid, e.g., poly(methylmethacrylate), styrene polymers and copolymers, and the like. Examples of inorganic matte particles are glass, silicon dioxide, titanium dioxide, magnesium oxide, aluminum oxide, barium sulfate, calcium carbonate, and the like. Matte particles and the way they are used are further described in U.S. Pat. No. 3,411,907 of Smith et al, issued Jan. 3, 1995, U.S. Pat. No. 3,754,924 of DeGeest et al, issued Aug. 28, 1973, U.S. Pat. No. 4,855,219 of Bagchi et al, issued Aug. 8, 1989, U.S. Pat. No. 5,279,934 of Smith et al, issued issued Jan. 18, 1994, U.S. Pat. No. 5,288,598 of Sterman et al, issued Feb. 22, 1994, U.S. Pat. No. 5,378,577 of Smith et al, issued Jan. 3, 1995, U.S. Pat. No. 5,563,226 of Muehibauer et al, issued Oct. 8, 1996 and U.S. Pat. No. 5,750,328 of Melpolder et al, issued May 12, 1998.

A wide variety of materials can be used to prepare the protective backing layer that is compatible with the requirements of photothermographic elements. The protective layer should be transparent and should not adversely affect sensitometric characteristics of the photothermographic element such as minimum density, maximum density and photographic speed. Useful protective layers include those comprised of poly(silicic acid) and a water-soluble hydroxyl containing monomer or polymer that is compatible with poly(silicic acid) as described in U.S. Pat. No. 4,741,992 of Przezdziecki, issued May 3, 1988 and U.S. Pat. No. 4,828,971 of Przezdziecki, issued May 9, 1989. A combination of poly(silicic acid) and poly(vinyl alcohol) is particularly useful. Other useful protective layers include those formed from polymethylmethacrylate, acrylamide polymers, cellulose acetate, crosslinked polyvinyl alcohol, terpolymers of acrylonitrile, vinylidene chloride, and 2-(methacryloyloxy) ethyl-trimethylammonium methosulfate, crosslinked gelatin, polyesters and polyurethanes.

Particularly preferred protective layers are described in U.S. Pat. No. 5,310,640 of Markin et al, issued May 10, 1994 and U.S. Pat. No. 5,547,821 of Melpolder et al, issued Aug. 20, 1996.

The photothermographic elements according to the invention can comprise a variety of supports that can tolerate the processing temperatures useful in developing an image. Typical supports include cellulose ester, poly(vinyl acetal), poly(ethylene terephthalate), polycarbonate and polyester film supports. Related film and resinous support materials, as well as paper, glass, metal and the like supports that can withstand the described processing temperatures are also useful. Typically a flexible support is most useful.

Coating procedures known in the photographic art can coat the photothermographic compositions on a suitable support. Useful methods including dip coating, air-knife coating, bead coating using hoppers, curtain coating or extrusion coating using hoppers. If desired, two or more layers can be coated simultaneously.

The described silver halide and oxidation-reduction image-forming combination can be in any suitable location in the photothermographic element which produces the desired image. In some cases it can be desirable to include certain percentages of the described reducing agent, the silver salt oxidizing agent and/or other addenda in a protective layer or overcoat layer over the layer containing the other components of the element as described. The components, however, must be in a location that enables their desired interaction upon processing.

It is necessary that the photosensitive silver halide, as described, and other components of the imaging combination be "in reactive association" with each other in order to produce the desired image. The term "in reactive association," as employed herein, is intended to mean that the photosensitive silver halide and the image-forming combination are in a location with respect to each other, which enables the desired processing and produces a useful image.

A useful embodiment of the invention is a photothermographic silver halide composition capable of being coated on a support. The composition comprises (a) an aqueous photosensitive silver halide emulsion containing a cationic starch peptizer with (b) a hydrophilic polymeric binder consisting essentially of a polyvinylalcohol and (c) an oxidation-reduction image-forming combination comprising (i) an aqueous, silver salt of a long-chain fatty acid consisting essentially of silver behenate and a surface modifier (ii) an organic reducing agent consisting essentially of a sulfonamidophenol. This composition can be coated on a suitable support to produce a photothermographic element according to the invention. Another embodiment of the invention is a method of preparing a photothermographic element comprising coating the resulting composition onto a suitable support to produce a photothermographic element as desired.

Elements of the invention can be imaged using a variety of methods. The elements can be imaged using any suitable source of radiation to which the photothermographic material is sensitive. The imaging materials according to the invention are typically sensitive to the ultraviolet and blue regions of the spectrum and exposure sources that provide this radiation are useful.

Typically, however, if a spectral sensitizing dye (or combination of spectral sensitizing dyes) is present in the photothermographic material, exposure using other ranges of the electromagnetic spectrum can be useful. Typically, a photothermographic material according to the invention is exposed imagewise with a visible light source, such as a tungsten lamp or laser or an infrared light source, such as a laser or a light emitting diode (LED). Other sources of radiation can be useful and include, for instance, electron beams, X-ray sources and the like. The photothermographic materials are typically exposed imagewise to produce a developable latent image.

A visible image can be developed in the photothermographic material within a short time, such as within several seconds, merely by heating the photothermographic material to moderately elevated temperatures. For example, the exposed photothermographic material can be heated to a temperature within the range of about 100° C. to about 200° C., such as a temperature within the range of about 110° C. to about 140° C. Heating is carried out until a desired image is developed, typically within about 2 to about 30 seconds, such as 2 to 15 seconds. Selection of an optimum processing time and temperature will depend upon such factors as the desired image, particular components of the photothermographic element, the particular latent image and the like.

The necessary heating of the described photothermographic material to develop the desired image can be accomplished in a variety of ways. Heating can be accomplished using a simple hot plate, iron, roller, infrared heater, hot air or the like.

Processing is typically carried out under ambient conditions of pressure and humidity. Pressures and humidity outside normal atmospheric conditions can be useful if desired; however, normal atmospheric conditions are preferred.

EXAMPLES

Example 1

Emulsion ES1: Precipitation of Silver Halide Emulsion in the Presence of a Water Dispersible Cationic Starch Peptizer A starch solution was prepared by heating at 80° C. for 30 min a stirred mixture of 4L distilled water and 240 g of STA-LOK® 140, an oxidized cationic waxy corn starch. (The starch derivative, STA-LOK® 140 is 100% amylopectin that had been treated to contain quaternary ammonium groups and oxidized with 2 wt % chlorine bleach. It contains 0.31 wt % nitrogen and 0.00 wt % phosphorous. It was obtained from A. E. Staley Manufacturing Co., Decatur, Ill.) After cooling to 30° C., the weight was adjusted to 4.0 kg with distilled water and 4g of sodium acetate trihydrate was added. The pBr was adjusted to 3.35 with a dilute NaBr solution, then while maintaining the pH at 5.0, 2.0 mL of saturated bromine water (~0.9 mmole) was added dropwise with stirring. The bromine water addition was completed a few minutes prior to the start of the precipitation.

To a vigorously stirred reaction vessel of this starch solution, at 30° C. and maintained at pH 5.0 throughout the emulsion precipitation, a 2.5 M $AgNO_3$ solution was added at 250 mL per min until 4.0 moles of silver had been added. Concurrently, a salt solution, 2.43 M in NaBr, 0.075 in M KI, and 0.47 g/L in bromine, was added at a rate needed to maintain a pBr of 3.35.

The resulting fine grain emulsion was washed by ultrafiltration at 30° C. to a conductivity of 3 mS ("mS" refers to millisiemens, a recognized measure of ionic conductivity) while adding a dilute NaBr solution, as necessary, to maintain a pBr of at least 3.35.

The resulting emulsion, ES-1, consisted of iodobromide (3% I), cubic grains of a mean edge length of 47 nanometers and a standard deviation in edge length of 1.19. It contained approximately 60 g of oxidized cationic starch per mole silver.

Dispersion MSBH: Aqueous Microparticulate Silver Behenate Colloidal Dispersion

A). Silver Behenate Wet Cake

A 3785 L reactor was initially charged with 1060 kg demineralized water, 96 kg methanol, and 54.4 kg of behenic acid (nominally 90% behenic acid (Unichema) recrystallized from isopropanol). The reactor was then heated to 70° C. When the reactor reached 70° C., 76.4 kg of 10.85% w/w KOH solution were added to the reactor using a gear pump. The reactor was then heated to 85° C. and held for 30 minutes. The reactor was then cooled to 70° C. Once the temperature had reached 70° C., a silver nitrate solution consisting of 24.74 kg of silver nitrate dissolved in 140 kg of demineralized water was added to the reactor at a constant rate during 30 minutes. The reactor was then cooled to 20° C. When the reactor reached 20° C., 1440 kg of demineralized water was added to the reactor. After stirring for 10 minutes, the stirrer was turned off. After one hour, the mixture had separated into two layers. The bottom layer consisted of clear liquors while the product had floated into the top layer. The bottom layer was discarded, and the wash procedure was repeated.

After the washes were completed, the remaining silver behenate suspension was deliquored using a centrifugal basket filter that was lined with a canvas filter media and then washed with demineralized water. After deliquoring, the yield was 173 kg of 40% w/w silver behenate "wet cake".

B). Aqueous Silver Behenate Microparticulate Dispersion.

Into a 5 liter container were added 600 grams of, 35% solids, aqueous silver behenate (AgBeh) "wet cake", and 271 grams of 6.2% aqueous solution of polyvinyl alcohol (PVA, Elvanol® 52–22 86–89% hydrolyzed (Dupont))

The resulting mixture was mixed in a blender for 2 hours at high-speed (4200 rpm) using a Cowles-type saw tooth impeller (40mm diameter) at the temperature of 21° C. to make Dispersion MSBH.

Coating IE-1 (An element of the invention) Aqueous Photothermographic Imaging Element Formulated Using Silver Behenate Dispersion and Starch precipitated Emulsion The coating melt was prepared by mixing 149.5 grams of 7.0% aqueous solution of polyvinyl alcohol (PVA, Elvanol 52-22 86–89% hydrolyzed (DuPont)) with 97.6 grams of Dispersion MSBH. Then 3.06 grams of succinimide, 2.01 grams of 185 g/l aqueous solution of sodium iodide, and 3.54 g of 4 g/l aqueous solution of mercuric bromide was added. The mixture was stirred overnight. Next was added 45.5 g of a well stirred mixture consisting of 23.5 g of a 0.19% 1:1 methanol water solution of the spectral sensitizing dye RD-1 and 17.57 mmole of the ES-1 emulsion. To the resulting mixture was added 42.8 g of a solid particle dispersion of developer Dev-1. (The solid particle dispersion had been prepared by milling a 15% solution of Dev-1, with 1.2% PVP and 0.3% SDS in water.)

The above prepared coating melt was coated onto a clear gelatin-subbed, 0.178-mm thick poly(ethylene terephthalate) support at a laydown of 86.95 g/m$^2$ to form an imaging layer of the dry composition shown in Table 1.

TABLE 1

Photothermographic Imaging Layer Dry Coverage

| Components | Dry Coverage (g/m$^2$) |
|---|---|
| Succinimide | 0.761 |
| Dev-1 | 1.594 |
| Starch precipitated cube silver laydown | 0.472 |
| RSD-1 | 0.011 |
| Silver behenate | 6.956 |
| Polyvinyl Alcohol (PVA, Elvanol 52-22 from DuPont, 86–89% hydrolyzed) | 3.260 |
| Sodium Iodide, USP | .092 |
| Mercuric bromide | 0.00196 |

The resulting imaging layer was then overcoated with a mixture of polyvinyl alcohol and hydrolyzed tetraethyl orthosilicate as described in Table 2 at a coverage of 40.4 cc/m$^2$ to have the composition as shown in Table 3

TABLE 2

Overcoat Solution

| Component | Grams |
|---|---|
| Distilled Water | 1158.85 grams |
| Polyvinyl Alcohol (PVA, Elvanol 52-22 from DuPont, 86–89% hydrolyzed) (6.2% by weight in distilled water) | 763.43 |
| Tetraethyl Orthosilicate solution comprising of 178.5 grams of water 1.363 grams of p-Toluene Sulfonic Acid, 199.816 grams of Methanol, 207.808 grams of Tetraethyl Orthosilicate | 489.6 |
| Aerosol OT (0.15% by weight in distilled water. (Aerosol OT is a sodium bis-2-ethylhexyl sulfosuccinate surfactant and is available from the Cytec Industries, Inc.., U.S.A.) | 75.00 |
| Zonyl FSN (0.05% by weight in distilled water. (Zonyl FSN surfactant is a mixture of fluoro-alkyl poly(ethyleneoxide) alcohols and is a trademark of and available from the Dupont Corp., U.S.A.) | 3.13 |
| Silica (1.5 micron) | 3.0 |

TABLE 3

Overcoat Layer Dry Coverage

| | |
|---|---|
| PSA (Silicate) | 1.302 |
| PVA | 0.872 |
| Aerosol OT | 0.0624 |
| Zonyl FSN | 0.0207 |

Example 2

This is a Comparative Example

Coating IE-2 Aqueous Photothermographic Imaging Element Formulated Using AgBeh Dispersion and Gelatin Precipitate Comparative Emulsion This comparative control, Example IE-2, was prepared similar to Example IE-1 except that a silver iodobromide emulsion made using gelatin as the peptizer, Emulsion ES-2, and was substituted for Emulsion ES-1. Emulsion ES-2 consisted of silver iodobromide (3% I), cubic grains of a mean edge length of 57 nanometers and contained 20 g gelatin per mole of silver.

Exposure and Processing

The Coating IE-1 (of the invention) and Coating IE-2 (comparative control) were exposed using the 683 nm, 50 mW, diode laser sensitometer and heat processed at 123C for 5 sec to produce a developed silver image. Both of the images had a Dmax of>2.75. A comparison of the Dmin values of the resulting images is show in Table 4.

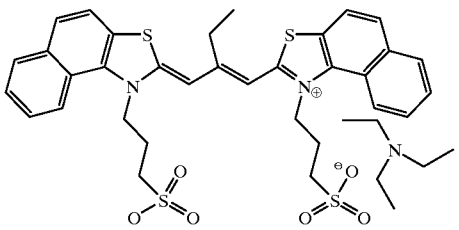

Spectral Sensitizing Dye RD-1 (red sens.)

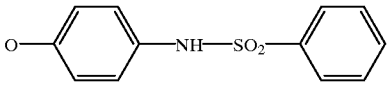

Developer Dev-1

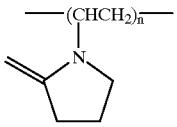

PVP $H_3(CH_2)_{11}—SO_4^-Na^+$ SDS

TABLE 4

Photothermographic Response in Dmin

| | Dmin Density Comparative Example Gelatin precipitated | Dmin Density Patent Example Starch precipitated |
|---|---|---|
| Fresh | 0.249 | 0.169 |
| Natural age 30 days | 0.261 | 0.167 |
| Natural age 60 days | 0.310 | 0.195 |
| Natural age 90 days | 0.364 | 0.222 |
| 1 week/120 F/50% RH | 0.353 | 0.223 |

What is claimed is:

1. An aqueous photothermographic composition comprising a) a photosensitive silver halide emulsion precipitated in a water dispersible cationic starch peptizing agent and b) an oxidation-reduction imaging forming composition comprising (I) a colloidal dispersion of silver compound particles and (ii) an organic reducing agent.

2. An aqueous photothermographic composition according to claim 1 wherein said water dispersible cationic starch peptizing agent has been oxidized.

3. An aqueous photothermographic composition according to claim 1 wherein the photosensitive silver halide emulsion precipitated in a water dispersible cationic starch is additionally precipitated in the presence of an oxidizing agent capable of oxidizing metallic silver.

4. An aqueous photothermographic composition according to claim 3 wherein the oxidizing agent is bromine or a bromine precursor.

5. An aqueous photothermographic composition according to claim 1 wherein the cationic starch is comprised of amylopectin.

6. An aqueous photothermographic composition according to claim 1 wherein the starch contains cationic moieties selected from among protonated amine moieties and quaternary ammonium, sulfonium and phosphonium moieties.

7. An aqueous photothermographic composition according to claim 1 wherein the cationic starch contains alpha-D-glucopyranose repeating having 1 and 4 position linkages.

8. An aqueous photothermographic composition according to claim 7 wherein the cationic starch additionally contains 6 position linkages in a portion of the alpha-D-glucopyranose repeating units to form a branched chain polymeric structure.

9. An aqueous photothermographic composition according to claim 1 wherein the cationic starch is dispersed to at least a colloidal level of dispersion.

10. An aqueous photothermographic composition according to claim 9 wherein the cationic starch is at least in part present as an aqueous solute.

11. An aqueous photothermographic composition according to claim 9 wherein the silver halide emulsion grains are chemically sensitized.

12. An aqueous photothermographic composition according to claim 9 wherein the silver halide emulsion grains are chemically sensitized with at least one of sulfur, gold, and reduction sensitizers.

13. An aqueous photothermographic composition according to claim 1 wherein said silver carboxylate is a silver salt of a long chain fatty acid.

14. An aqueous photothermographic composition according to claim 13 wherein said silver salt is a salt of a long chain fatty acid containing 8 to 30 carbon atoms.

15. An aqueous photothermographic composition according to claim 14 wherein said silver carboxylate is silver behenate.

16. An aqueous photothermographic element comprising a support having coated thereon an aqueous photothermographic composition comprising a) a photosensitive silver halide emulsion precipitated in a water dispersible cationic starch peptizing agent and b) an oxidation-reduction imaging forming composition comprising (I) a colloidal dispersion of silver compound particles and (ii) an organic reducing agent.

17. An element according to claim 16 further having a protective layer.

* * * * *